US006450903B1

(12) United States Patent
Tate

(10) Patent No.: US 6,450,903 B1
(45) Date of Patent: Sep. 17, 2002

(54) GOLF PRACTICE AID SYSTEM

(76) Inventor: John R. Tate, 11621 Markon Dr., Garden Grove, CA (US) 92841

( * ) Notice: Subject to any disclaimer, the term of this patent is extended or adjusted under 35 U.S.C. 154(b) by 66 days.

(21) Appl. No.: 09/590,956

(22) Filed: Jun. 9, 2000

Related U.S. Application Data

(63) Continuation-in-part of application No. 09/426,786, filed on Oct. 22, 1999, now Pat. No. 6,170,088, and a continuation-in-part of application No. 09/395,282, filed on Sep. 13, 1999, now Pat. No. 6,176,792.

(51) Int. Cl.[7] ..... A63B 57/00
(52) U.S. Cl. ..... 473/406; 473/236
(58) Field of Search ..... 473/285, 236, 473/286, 406; 224/918

(56) References Cited

U.S. PATENT DOCUMENTS

| | | | | | |
|---|---|---|---|---|---|
| 3,194,564 | A | * | 7/1965 | Swan | 473/236 |
| 3,437,341 | A | * | 4/1969 | Hasten, Jr. et al. | 473/236 |
| 4,017,082 | A | * | 4/1977 | Channing et al. | 473/286 |
| 4,239,216 | A | * | 12/1980 | Bauer | 473/286 |
| 5,417,426 | A | * | 5/1995 | Bayer | 473/286 |
| 5,441,268 | A | * | 8/1995 | Shier | 473/236 |
| 6,142,348 | A | * | 11/2000 | Park | 224/918 |
| 6,200,226 | B1 | * | 3/2001 | Regan | 473/406 |
| 6,296,574 | B1 | * | 10/2001 | Kaldis | 473/236 |

* cited by examiner

*Primary Examiner*—Steven Wong
(74) *Attorney, Agent, or Firm*—Charles H. Thomas

(57) ABSTRACT

At least one, and preferably a pair, of golf ball markers with magnets incorporated therein are employed in combination with a golf putter as a putting training aid. The golf ball markers may be placed a short distance apart on the ball-impact impact face of the putter for a golfer to practice putting. If the golfer correctly brings the putter face into contact with the ball, the ball will be impacted by the center of the face directly between the two magnetized ball markers. If the golfer's putting stroke is not correct, one or the other of the ball markers will strike the ball, thereby creating a tactile sensation transmitted through the putter shaft that informs the golfer of the error in execution of the putting stroke. Magnetic golf ball markers may also be used in combination with a putter in other ways to develop a putting stroke that is consistently correct. The golfer places two of the golf ball markers with magnets incorporated therein on a golf putting practice surface. One of these markers is placed directly in front of the golf ball and one directly behind it. On the backswing, the magnetic golf ball marker behind the golf ball will spring up onto the sole of the putter head with an audible click if the putter head remains near the golf putting practice surface during the backstroke. As the putting stroke is executed, and with a proper follow through, the ball marker in front of the golf ball will be magnetically attracted to the sole of the putter head if the putter head remains near the golf putting practice surface.

7 Claims, 6 Drawing Sheets

GOLF PRACTICE AID SYSTEM

The present application is a continuation in part of U.S. application Ser. No. 09/426,786 filed Oct. 22, 1999, now U.S. Pat. No. 6,170,088, and U.S. application Ser. No. 09/395,282 filed Sep. 13, 1999, now U.S. Pat. No. 6,176,792.

BACKGROUND OF THE INVENTION

1. Field of the Invention

The present invention relates to the combination of a golf ball marker which incorporates a permanent magnet in its structure with a golf putter having a club head formed of a material attracted by magnetism and -the use of that combination as an aid for golf putting practice.

2. Description of the Prior Art

During a round of golf quite frequently a golfer will arrive at a green in preparation for a golf putt, but will sometimes have to wait for several minutes for other golfers to complete their shots. During this time the golfer can contemplate the best way to execute the golf putt that is required to maximize the likelihood that the golfer's next putt will drop in the hole. In this connection it is often useful for the golfer to practice a proper putting stance, manner of addressing the ball, and swing of the golf putter club.

Many golfers have difficulty putting because the line of movement of the golf putter during the putting stroke is not precisely perpendicular to the face of the putter. As a consequence, when the plane of the impact face of the putter strikes the golf ball, it does so at a slight angle which will cause the ball to travel along a path at a slight angle to the plane of the putter stroke. Even a very slight error in this regard will result in a putt that travels to one side or the other of the cup.

Numerous putting aids exist which are designed to allow a-golfer to improve their putting strokes. However, conventional training aids involve devices which are too large or cumbersome to be carried along during the actual golf match. Rather, many conventional putting aids are designed for the golfer to utilize in private at a practice location, but not while awaiting a turn on the actual field of play.

SUMMARY OF THE INVENTION

The present invention involves the use of a flat golf ball marker which incorporates a permanent magnet in its structure in combination with a golf putter as a practice aid to golfers for practicing putting. The construction of such a golf ball marker is described in pending U.S. application Ser. No. 09/426,786 filed Oct. 22, 1999. This application is hereby incorporated by reference in its entirety. As described in that application, a golf ball marker into which a magnet has been incorporated may be carried externally on an article of golf clothing into which an iron or steel object has been embedded. Golf ball markers with magnets in them may thereby be worn and prominently displayed on golf hats, caps, sun visors, golf gloves, golf towels, golf bags and other golf accessories.

However, I have devised yet another use of a golf ball marker having a magnet in it. By utilizing such a golf ball marker on a golf putter having a golf club head formed of iron, steel, or any other material that is attracted:.by magnetism, a most effective golf putting training aid is created.

The unique combination of elements of the present invention may be utilized in several different ways to improve the proficiency of a golfer's putting game. The use of a single golf ball marker into which a permanent magnet has been incorporated can be used to advantage in this connection. However, even greater advantages are gained by utilizing a pair of golf ball markers each having a magnet within its structure in combination with a golf putter.

The club head of the golf putter employed in the practice aid of the invention must be formed of a material attracted by magnetism, such as iron or steel. While some golf putter club heads are formed of brass or aluminum, the vast majority are now made of steel, which is attracted by magnetism. A golf ball marker having a magnet within its structure will be attracted to such a golf putter club head and will adhere to it due to the force of magnetic attraction. As a consequence, such a golf ball marker may be utilized in combination with such a golf putter to fine tune a golfer's putting game.

To illustrate, it is well-known that for putting accuracy it is important for the ball-impact face of the golf putter club head to remain vertical throughout a golf putting stroke. In a correct putting stroke the putter club head should be brought straight back and then forward again close to the ground with a rhythmic movement. The ball-impact face should remain vertical during the putting back stroke and also during the putting stroke follow through in order to assure that it is vertical at the critical moment, which is the moment of impact against the ball.

It is also extremely important for the plane of the ball-impact face to be perpendicular to the intended path of travel of the golf ball at the moment of impact. To assure that the ball-impact face is at this orientation when it strikes the golf ball it should be perpendicular to that intended path of travel during the putting backswing and also during the follow through of the putting stroke. Furthermore, it is very important for the sole of the putter club head to remain very close to the putting green during the back stroke and the follow through. However, there is a tendency by many golfers to lift the golf club putter head during the back stroke and during the follow through. As a consequence, the putter club head moves in an arc, rather than in a linear path during the putting stroke. This greatly increases the likelihood of a misdirected putt.

To improve the consistency of a golfer's putting stroke a golf ball marker having a magnet therein may be placed upon the flat ball-impact face of the golf putter club head at a location offset from the "sweet spot" at the center of the club face in the direction of either the heel or the toe of the club head. Therefore, during practice putts a golfer will immediately become aware of an impact against the ball marker if there is an error in execution of the putting stroke that brings the ball marker into contact with the golf ball. The tactile sensation transmitted to the golfers hands through the shank of the putter if the ball marker rather than the center of the ball impact putter face strikes the golf ball is unmistakable.

While use of a single magnetic golf ball marker in this manner is advantageous, the use of a pair of golf ball markers, each having a magnet therewithin, is of considerably greater benefit. That is, one of the magnetic ball markers can be placed on the ball-impact face of the putter between the heel of the club and the midpoint of the ball-impact face. The other magnetic ball marker can be placed on the ball-impact face of the putter between the toe of the club and the midpoint of the ball-impact face. If the golfer executes the putting stroke in such a manner as to strike the golf ball with the club head either too close to the heel or to close to the toe one or the other of the ball markers will strike the golf ball. The golfer is thereby provided with an unmistakable indication of a faulty putting stroke.

Similarly, one or a pair of golf ball markers containing a magnet therein can be utilized to improve a goffer's putting game in another way. Specifically, a magnetic golf ball marker is placed on the putting practice surface a few inches behind the golf ball. During the proper execution of a putting backswing, the putter club head will remain close to the putting surface so that the magnetic ball marker will be pulled onto the sole of the club head as the putter head passes over the ball marker. The transfer of the golf ball marker onto the sole of the putter club head produces an audible sound, namely a "click". However, if the putter head is lifted slightly from the putting practice surface during the back stroke, as will occur if the putter is swung in an arc in a vertical plane, the distance of separation of the club head sole from the magnetic ball marker resting on the putting practice surface will be too great for the ball marker to be attracted onto the club head sole.

Likewise, another magnetic ball marker may be placed a few inches ahead of the golf ball. If the golfer lifts the putter head away from the putting practice surface during execution of the putting stroke, the distance between the magnetic ball marker resting on the putting practice surface in front of the position of the golf ball and the sole of the putter club head will be great enough so that the ball marker will not be lifted by the force of magnetism up to the club head sole. On the other hand, if the putter club head sole remains close to the putting practice surface during the putting stroke follow through, the magnetic attraction of the magnetic ball marker to the sole of the putter club head will cause the magnetic ball marker to be lifted from the putting practice surface and to magnetically attach itself to the club head sole. This transfer is accompanied by an audible sound.

In one broad aspect the invention may be considered to be a golf putting training aid comprising in combination: a golf putter having a club head formed of a material attracted by magnetism and having a flat front ball-impact face and a sole extending rearwardly from the front ball-impact face, and at least one flat golf ball marker including a permanent magnet permanently incorporated therein, wherein the golf ball marker is removably detachable relative to the golf putter club head. While a single golf ball marker having a magnet in it may be used to advantage, the invention preferably is comprised of a pair of such golf ball markers.

In another broad aspect the invention may be considered to be a method of golf putting training on a putting practice surface utilizing a golf ball, a golf putter having a shaft with opposing ends and a grip at one hand and a club head formed of a material attracted by magnetism at an opposite end. The putter club head has a heel, a toe, a sole, and a flat front ball-impact face. At least one flat golf ball marker that includes a permanent magnet permanently incorporated therein is also utilized.

The steps of the invention comprise: placing the golf ball upon the golf putting surface; placing the golf ball marker on the ball-impact face offset from a point midway between the heel and the toe, whereupon the golf ball marker is held in position by magnetic force; holding the putter by the grip to address the golf ball with the club head ball-impact face oriented in a plane perpendicular to the putting practice surface while holding the sole of the club head proximate to the putting practice surface; drawing the putter club head away from the golf ball while holding the ball-impact face of the club head perpendicular to the putting practice surface and the sole of the club head proximate thereto; and bringing the putter club head toward the golf ball to strike the golf ball with the ball-impact face perpendicular to the putting practice surface while avoiding contact between the golf ball marker and the golf ball.

In still another broad aspect the invention may be considered to be a method of golf putting training on a putting practice surface utilizing a golf putter having a shaft with a grip at one end and a club head formed of a material attracted by magnetism at an opposite end. The club head has a flat, front ball-impact face and a sole extending rearwardly from the front ball-impact face. The method further utilizes at least one flat golf ball marker that includes a permanent magnet permanently incorporated therein.

The steps of this aspect of the invention comprise: establishing a spherical golf ball position atop the golf putting practice surface; placing the golf ball marker on the golf putting practice surface within six inches of the golf ball position, whereby an imaginary straight horizontal ball travel alignment line passing directly beneath the centers of both the golf ball position and the golf ball marker defines a desired direction of golf ball travel when the golf ball is putted and an imaginary flat vertical impact-face plane is tangent to the golf ball position and intersects and is perpendicular to the straight horizontal ball travel alignment line between the centers of the golf ball and the ball marker; holding of the putter by the grip to address the golf ball with the ball-impact face of the club head parallel to the impact-face plane and between the golf ball and the ball marker and with the club head sole located proximate to the putting practice surface; drawing the putter club head away from the golf ball and toward the ball marker in a backswing stroke while holding the putter ball-impact face parallel to the impact-face plane and the sole proximate the putting practice surface, whereby the ball marker is drawn by magnetism up into contact with the putter club head sole while making an audible noise as it does so; and bringing the putter club head toward the golf ball position in a putting stroke while maintaining the ball-impact face perpendicular to the desired direction of golf ball travel and with the club head sole remaining proximate the putting practice surface. In this aspect the method of the invention may be performed with or without a golf ball.

Preferably the method of practice is performed utilizing a pair of golf ball markers, each of which includes a permanent magnet within its structure. In the aspect of putting practice in which a magnetic ball marker is placed upon the ball-impact face of the putter club head to ensure that the center of the ball-impact face strikes the golf ball, one magnetic ball marker is placed between the club head heel and the point of the ball-impact face midway between the heel and the toe. The other magnetic ball marker is placed between the club head toe and the point of ball-impact face midway between the heel and the toe.

In the aspect of putting practice in which a magnetic ball marker is placed upon the putting practice surface to ensure that the sole of the putter club head remains close to the putting practice surface during the putting stroke, one magnetic ball marker is to placed a few inches to the rear of the golf ball position, while the other magnetic ball marker is placed a few inches in front of the golf ball position. If the putting back stroke is correct, the magnetic ball marker to the rear of the golf ball position will be lifted from the golf putting practice surface by the force of magnetism and attach itself to the sole of the club head as the club head passes over it during the backswing. If the putting stroke follow through is correct, the magnetic ball marker in front of the golf ball position will be lifted from the golf putting surface by the force of magnetism and attach itself to the sole of the club head as the club head passes over it during the follow through of the putting stroke.

The invention may be described with greater clarity :and particularity by reference to the accompanying drawings.

DESCRIPTION OF THE EMBODIMENT

Figure 1:
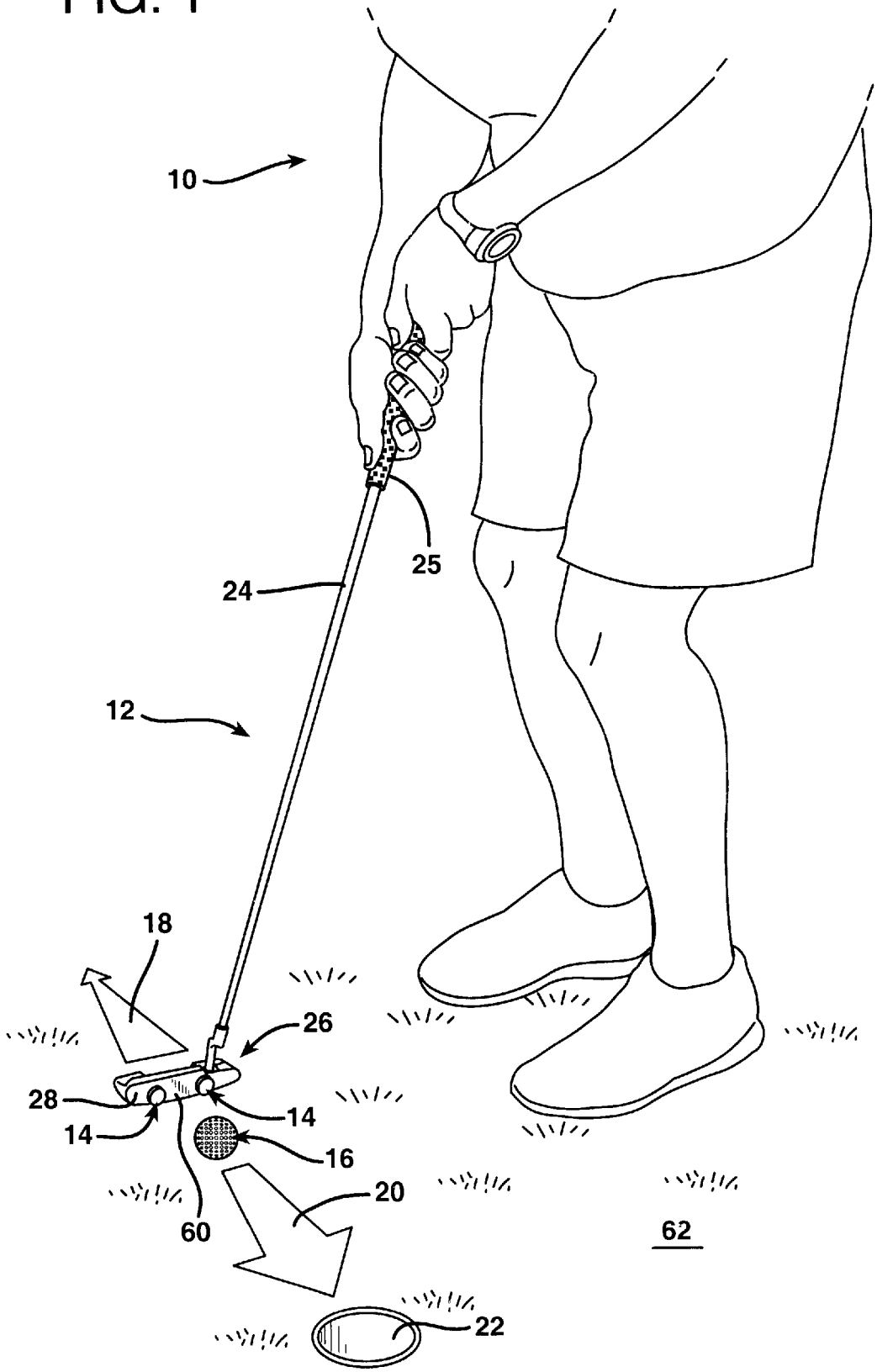
FIG. 1 is a perspective view illustrating one combination of a golf putter and a pair of golf ball markers having magnets therein according to the invention.

FIG. 1 illustrates a golfer indicated generally at 10 utilizing a golf putter 12 in combination with a pair of identical golf ball markers 14 according to the invention as a practice aid for golf putting. The golfer 10 first places the golf ball markers 14 on the ball impact face 28 of the golf putter head 26. The ball markers 14 are each located off-center on the ball-impact face 28, one closer to the heel 40 and the other closer to the toe 42. The golfer 10 then observes the alignment of the golf ball markers 14 relative to a golf ball 16 while moving the golf putter 12 in a backstroke, indicated by the directional arrow 18, and then forwardly in an actual putting stroke and follow through, as indicated by the directional arrow 20. By utilizing the golf ball markers 14 for purposes of alignment in combination with the golf putter 12, the golfer 10 is able to more precisely execute a proper backstroke 18 and putting stroke and follow through 20 so that the golf ball 16 will drop into the cup 22, even from a far greater distance than is indicated in FIG. 1.

The golf putter 12 has a shaft or shank 24, which may be formed of wood, metal, or some plastic composite material. The putter shaft 24 has opposing upper and lower ends. A conventional grip 25 is mounted on the upper end of the putter shaft 24. At its lower end the shaft 24 terminates in a golf putter club head 26. The club head 26 of the golf putter 12 must be formed of some material that is attracted by magnetism, typically steel.

Figure 2:
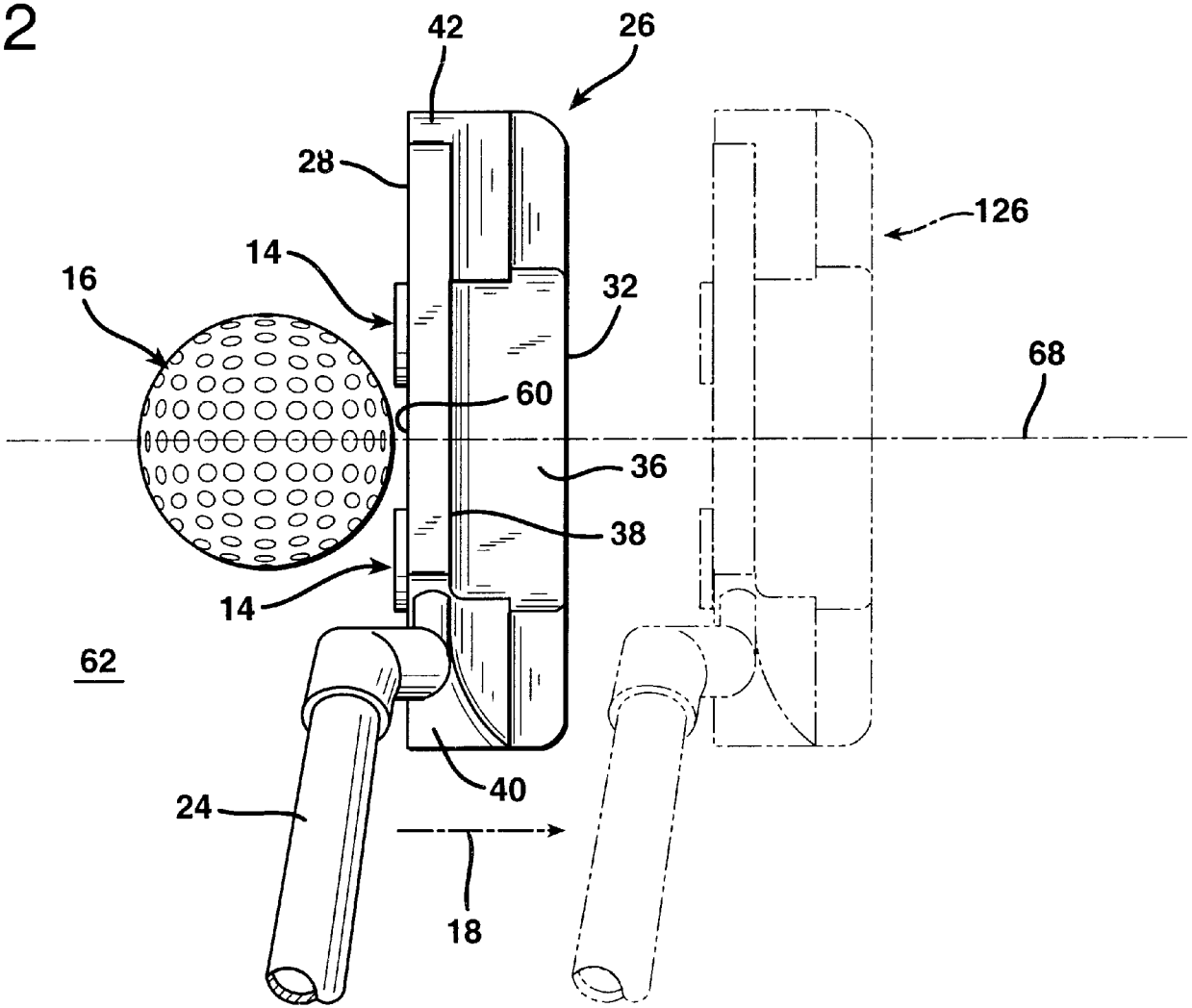
FIG. 2 is a top plan detail illustrating one method of use of the combination of a golf putter club head with a pair of golf ball markers with magnets therein, according to the invention, as aligned and moving in a proper backswing.
Figure 3:
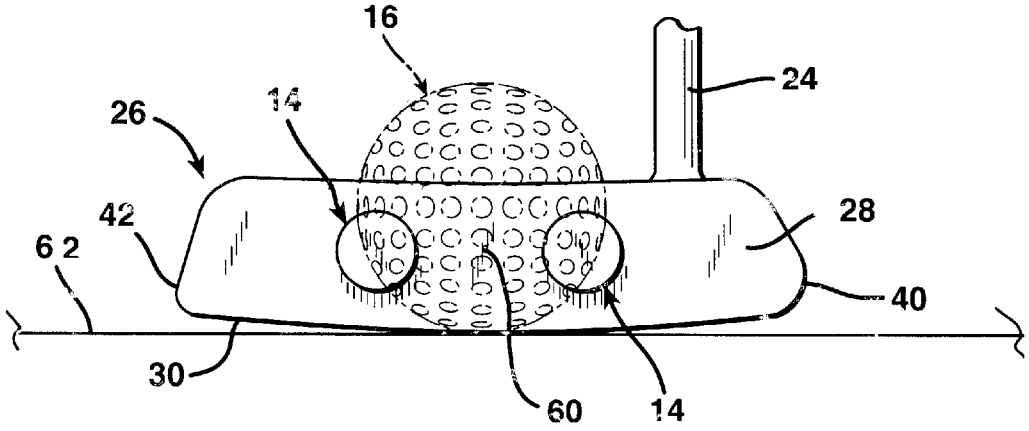
FIG. 3 is a front elevational detail illustrating proper execution of a putting stroke in the implementation of the method of golf putting training shown in FIGS. 1 and 2.

The configuration of the golf club head 26 is best illustrated in the detail drawings of FIGS. 2 and 3. The golf club head 26 has a flat, planar front ball-impact face 28, and a sole 30 extending rearwardly from the front ball-impact face 28. The golf club head 26 also has a back 32 that rises sharply upwardly from the sole 30 and perpendicular thereto.

Above the central region 32 there is a shelf 36 that has a flat surface oriented perpendicular to the front face 28 and which is generally parallel to the sole 30. A rear abutment face 38 extends up from the planar shelf 36 and is oriented perpendicular thereto, as illustrated in FIG. 2. The putter club head 26 is configured with a conventional heel 40 at its inboard end which is joined to the shaft 24 and a conventional toe 42 at its outboard end, remote from the connection to the shaft 24.

Figure 8:
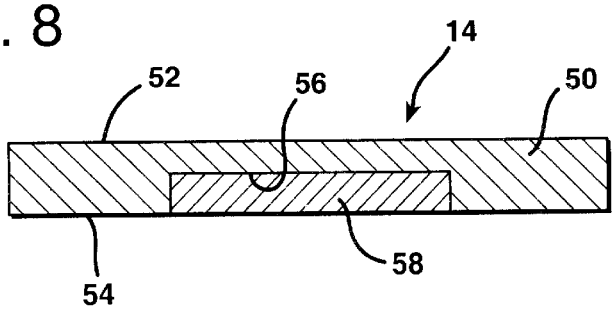
FIG. 8 illustrates one embodiment of a golf ball marker constructed with a magnet incorporated therein and utilized in the invention.

The construction of the ball marker 14 is illustrated in FIG. 8. The ball marker 14 is formed of a flat slab 50 of nonferrous material, such as brass or plastic. The slab 50 is stamped to have an outer disk-shaped configuration with a circular upper surface 52 and a circular undersurface 54. The upper surface 52 of the magnetically inert slab 50 typically bears an indicia which may be a raised embossment, an indented stamping, a painted symbol, decal or design, or any combination of different types of indicia utilized on a conventional ball marker. Very typically, an indicia will identify a particular golf tournament or country club. The undersurface 54 of the nonferrous slab 50 has a central, disk-shaped cavity 56 defined therein. The magnetically inert slab 50 is preferably formed from a material that is somewhat malleable, so that the cavity 56 can be defined by stamping a disk-shaped depression into the undersurface 54 of the slab 50. Alternatively, the cavity 56 may be formed by milling out material from the slab 50 at the center of the undersurface 56 using an end mill and lathe.

The cavity 56 accommodates and seats a small, flat, disk-shaped magnet 58 so that the magnet 58 can be permanently secured to the magnetically inert slab 50 by force fitting it into the cavity 56. The magnet 58 may be formed of any material that exerts a permanent magnetic field. The magnet 58 may be formed of magnetized iron, but is preferably a rare earth magnet, such as a Nd—Fe—B (Neodymium/Ferrum/Boron) alloy. Other rare earth magnetic materials which are also sold commercially are: MM Magnet [Magnequench (Bonded NdFeB)], SmCo Magnet (Samarium/Cobalt), and Alnico Magnet (Aluminum/Nickel/Cobalt).

FIGS. 1 through 4 illustrate the use of a pair of magnetic ball markers 14 in combination with the golf putter 12 in one manner of use as a putting practice aid. As shown in those drawing figures, one of the magnetic golf ball markers 14 is positioned on the front ball-impact face 28 of the putter club head 26, offset from the point 60 located midway between the end of the heel 40 and the end of the toe 42 at a location closer to the heel 40 than the toe 42. The ball marker 14 may be placed between about one-half of an inch and one inch from the center point 60 of the ball-impact face 28. The other golf ball marker 14 is located at the same distance from the center point 60 of the ball-impact face 28, but closer to the toe 42 than to the heel 40. The ball markers 14 are both equidistant from the center 60 of the ball-impact face 28. Both of the golf ball markers 14 are held in position against the ball-impact face 28 by the magnetic force of attraction exerted by the magnets 58 which are permanently mounted within the golf ball markers 14.

The golfer 10 holds the putter 12 by the grip 25 to address the golf ball 16 with the club head ball-impact face 28 just behind the golf ball 16, as illustrated in FIG. 1. The club head ball-impact face 28 is oriented in a plane perpendicular to the putting practice surface 62, as illustrated in FIG. 2. The sole 30 of the golf club head 26 is held proximate to the putting practice surface 62, as illustrated in FIG. 3.

The golfer 10 then draws the putter head 26 away from the golf ball 16 as indicated by the directional arrow 18 while holding the ball-impact face 28 of the club head 26 perpendicular to the putting practice surface 62 and the sole 30 of the club head 26 proximate to the putting practice surface 62. At the termination of the backswing 18 the club head 26 is at the position indicated in phantom at 126 in FIG. 2.

The golfer then brings the putter club head 26 toward the golf ball 16 to strike it with the ball-impact face 28 perpendicular to the putting practice surface 62 while avoiding contact between either of the golf ball markers 14 and the golf ball 16, as illustrated in solid lines in FIG. 2. If the putting stroke is executed properly the center point 60 of the ball-impact face 28 located midway between the end extremities of the heel 40 and the toe 42 strikes the golf ball 16 while the ball-impact face 28 remains perpendicular to both the golf putting practice surface 62 and an intended line of golf ball travel 68. The line of golf ball travel 68 may be considered to be a plane projection onto the putting practice surface 62 of a line extending through the center of the golf ball 16 and the point on the rear surface of the golf ball 16 at which the center point 60 of the ball-impact face 28 is supposed to make impact. It should be noted that if the putting stroke is executed properly as described, the spherical curvature of the golf ball 16 will prevent any contact from occurring between either of the golf ball markers 14 and the golf ball 16.

The alignment of both of the golf ball markers 14 aids a golfer in moving the putter 12 straight to the rear to a backswing position. FIG. 2 illustrates in phantom at 126 the position of the golf club head 26 at the extreme end of a short backstroke, directly behind the ball 16. The putter impact face 28 should remain perpendicular to the path of backswing movement, indicated at 18 in FIGS. 1 and 2. The golf ball markers 14 provide visual indicia to the golfer 10 that assist the golfer 10 in maintaining a perfect, straight linear backstroke path 18, so that the forward path of movement 20 of the club 26 passes through the center of the golf ball 16 and directly along the intended path of travel 68 of the ball 16. Moreover, by using a pair of golf ball markers 14, the golfer 10 is provided with guides proximate both the heel 40 and the toe 42 of the golf club 12. The pair of ball markers 14 assist the golfer in maintaining the ball 16 aligned with the center 60 of the ball-impact face 28. As a result, the forward path of travel of the club head 26 brings the club ball-impact face 28 into contact with the ball 16 at the "sweet spot", which is a the exact center point 60 of the face 28, and not off center toward either the heel 40 or the toe 42 of the club head 26.

The golfer 10 can use one or more of the golf ball markers 14 magnetically attached to the club head 26 as a golf practice aid in practicing putting toward an imaginary cup while awaiting his or her turn to shoot at a putting green. The golf ball markers 14 are held firmly to the ball-impact face 28 of the golf club putter head 26 by the force of magnetic attraction of the magnets 58 to the steel golf club head 26. The golf ball markers 14 further aid the golfer 10 in that the eyes of the golfer 10 are more likely to remain focused directly on the ball 16 as the ball-impact face 28 approaches the ball 16 to avoid hitting the ball 16 with either of the golf ball markers 14.

Figure 4:
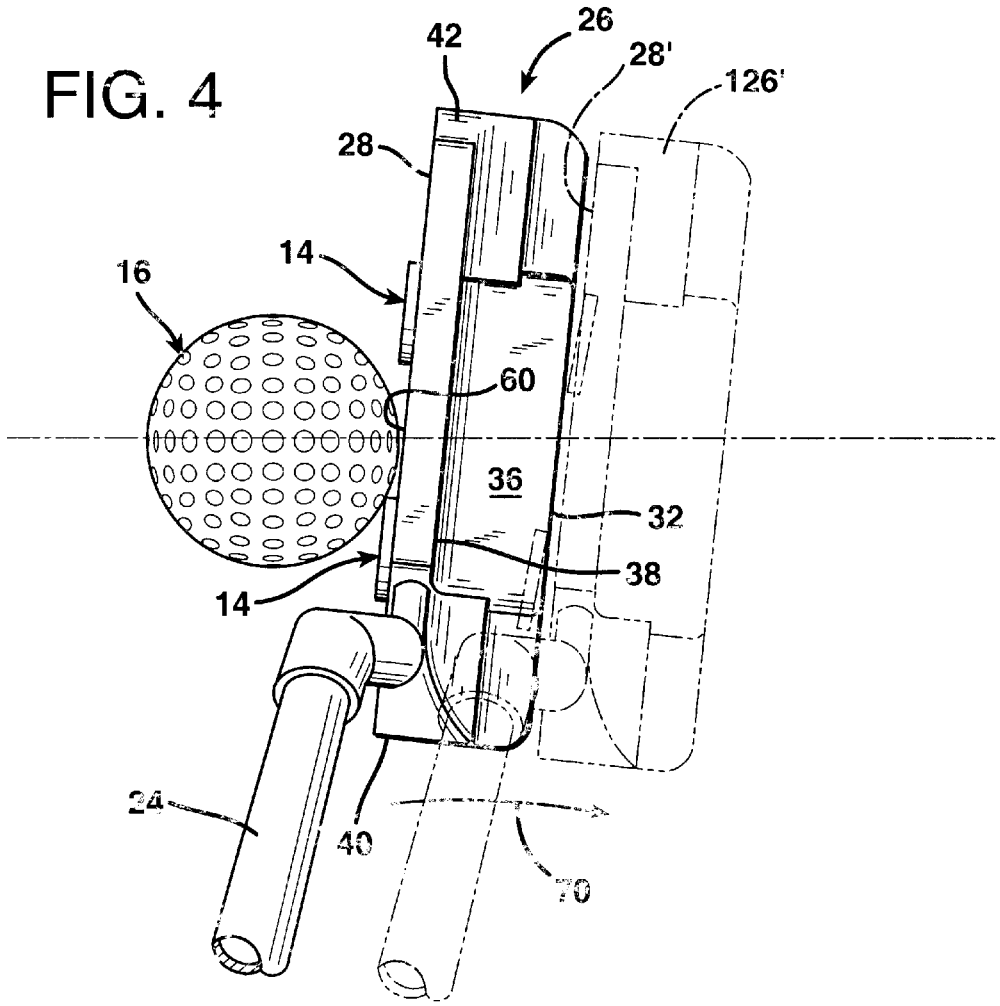
FIG. 4 is a top plan detail illustrating the manner in which a magnetic golf ball marker will indicate an improper execution of a putting stroke to a golfer.

If the golfer 10 brings the putter club head 26 rearwardly in a backstroke other then along the proper backstroke path 18, as for example along an arcuate path indicated at 70 in FIG. 4, the departure of movement of the club head 26 from the proper path 18 will bring the club head 26 to the position indicated at 126' in FIG. 4. While the golfer 10 may not readily detect the misalignment of the ball-impact face indicated at 28' in FIG. 4, this misalignment will become apparent when the club head 26 is brought forward to strike the golf ball 16. More specifically, and as illustrated in FIG. 4, the exact center point 60 of the ball-impact face 28 will not strike golf ball 16. Rather, the ball-impact face 28 will strike the golf ball 16 off center.

In the example illustrated in FIG. 4, the misaligned position of the golf club head 26 as it strikes the golf ball 16 results in contact between the ball marker 14 located between the center 60 of the ball-impact face 28 and the end of the heel 40. Contact between the golf ball marker 14 and the golf ball 16 can be felt by the tactile sensation transmitted from the ball marker 14 through the club head 26, up the putter shaft 24, through the grip 25 and to the hands of the golfer 10. The golfer 10 is thereby instantly aware of any improper execution of the putting stroke. A comparable tactile sensation will be felt if the ball marker 14 located between the center 60 and the end of the toe 42 strikes the golf ball 16.

Figure 5:
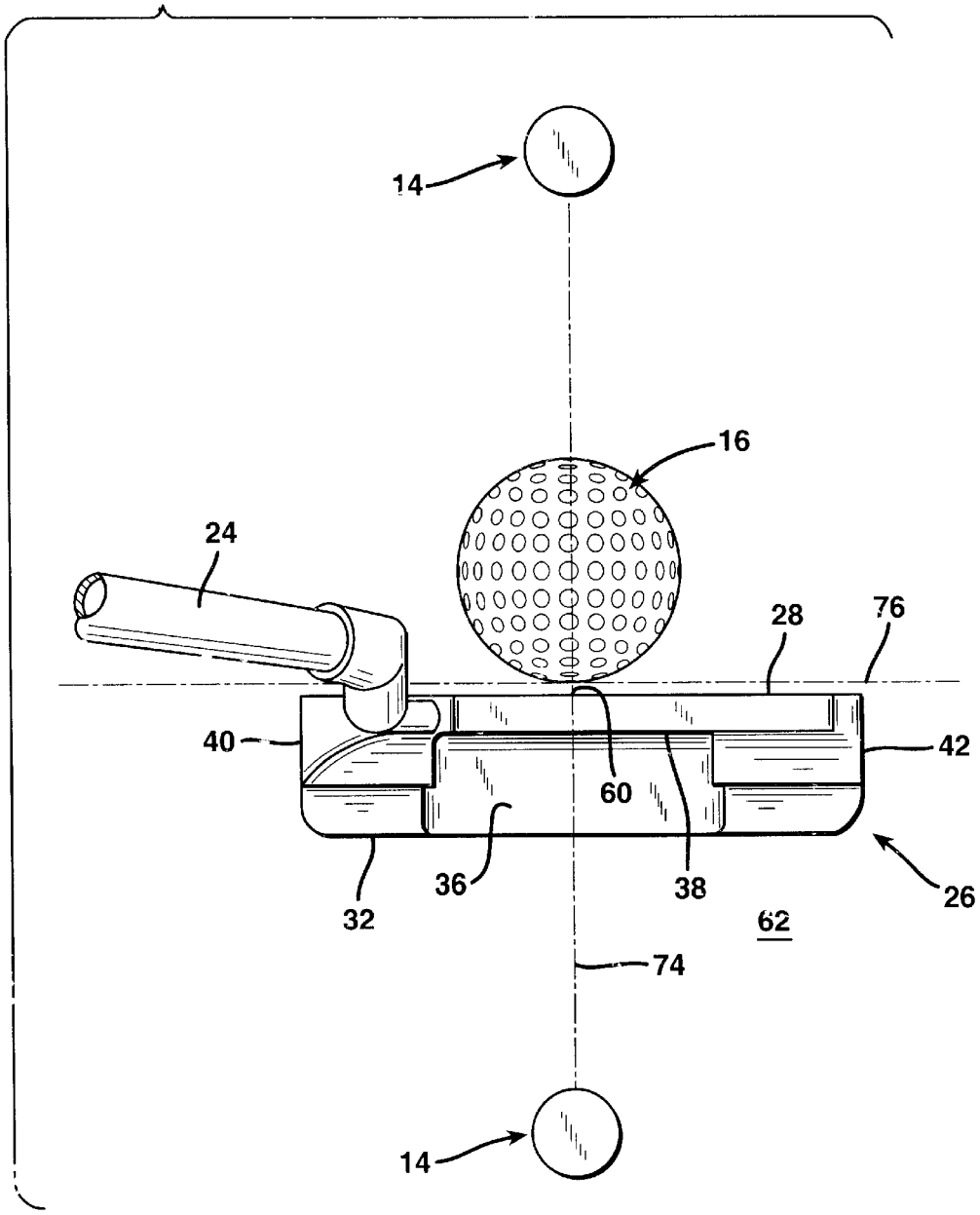
FIG. 5 is a top plan detail illustrating the use of the combination of the invention in addressing a golf ball in a different manner of implementation of the method of the invention.
Figure 6:
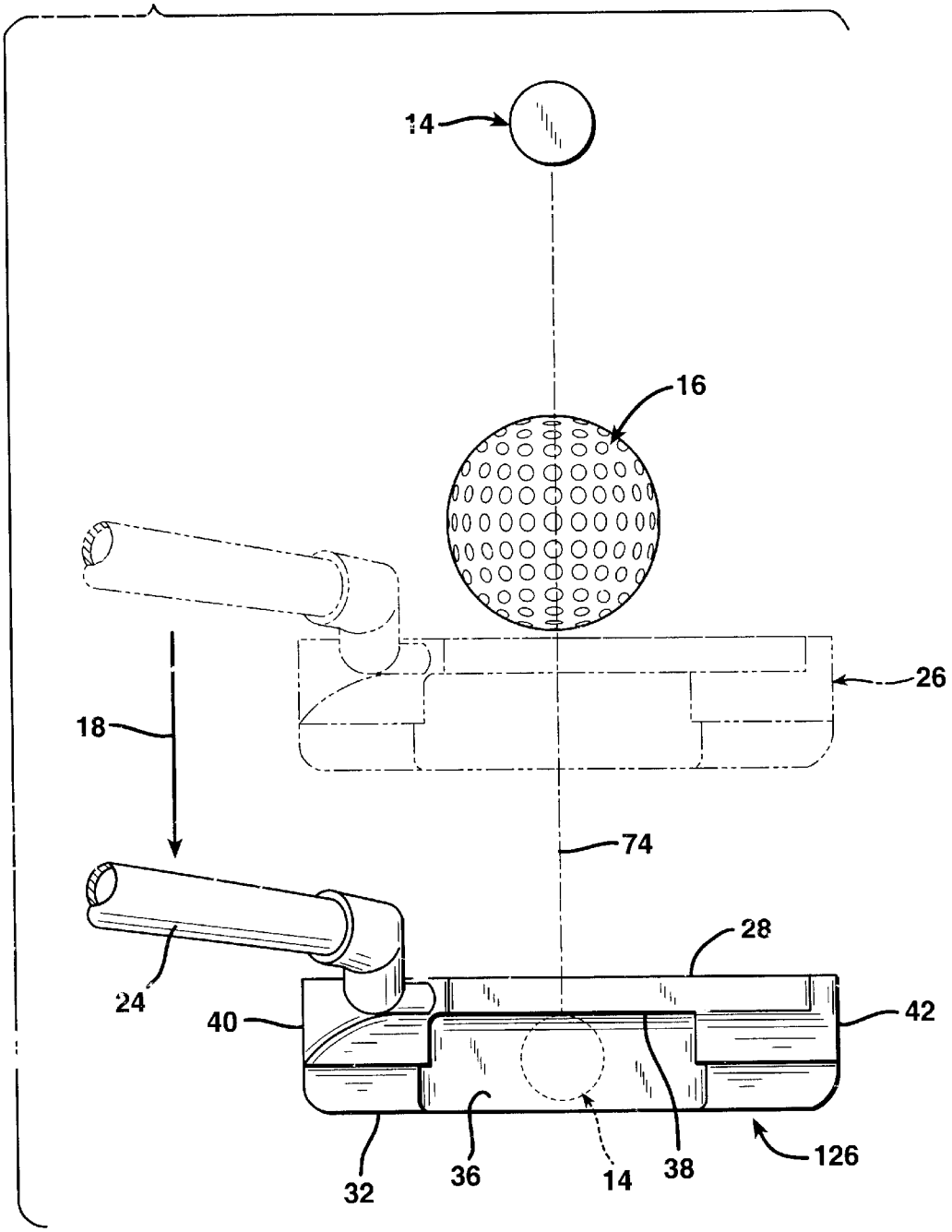
FIG. 6 is a top plan detail illustrating the use of the combination of the invention during a putting backswing in the manner of implementation illustrated in FIG. 5.
Figure 7:
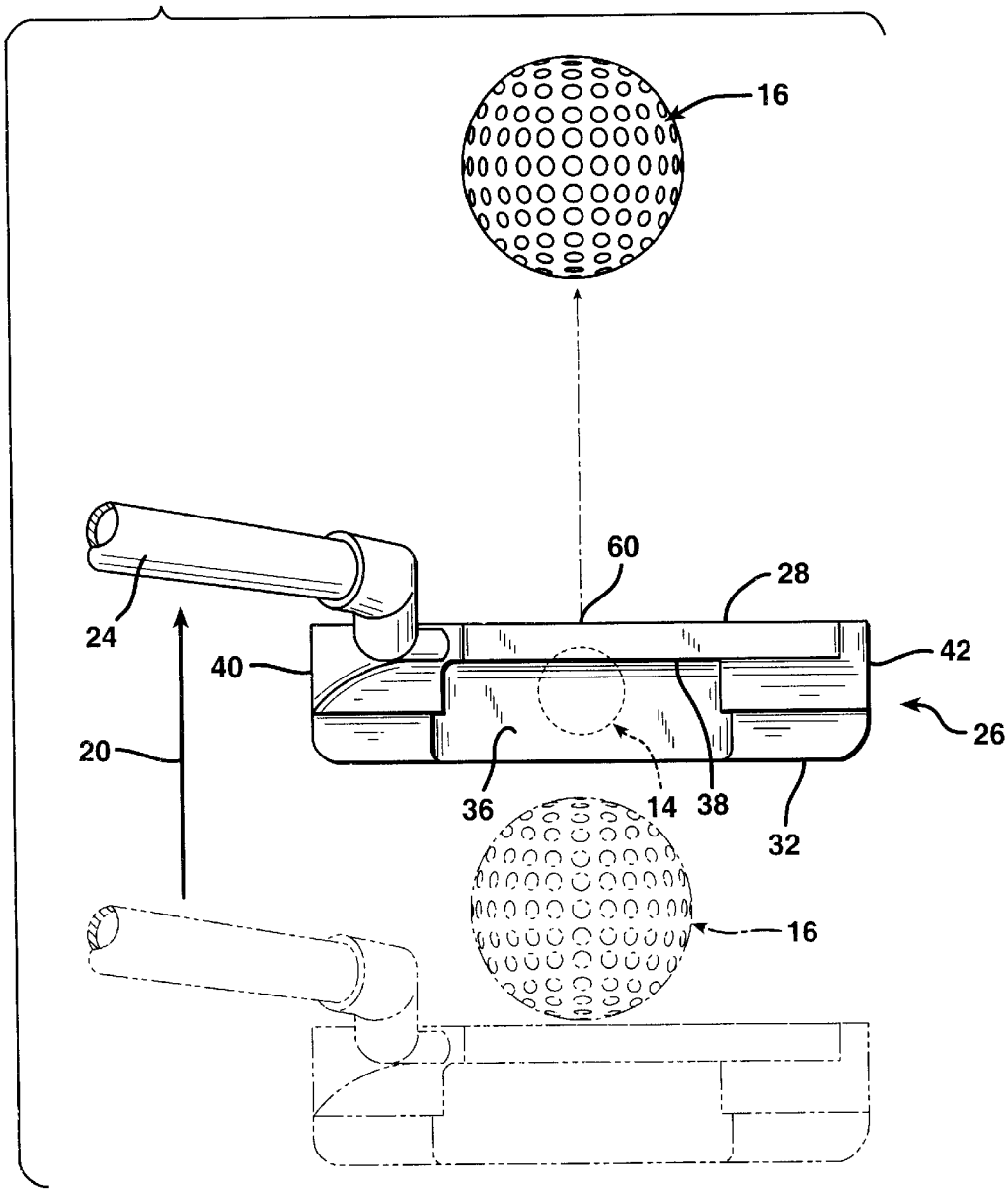
FIG. 7 is a top plan detail illustrating the use of the combination of the invention during a putting a stroke follow through in the manner of implementation illustrated in FIGS. 5 and 6.

The combination of a golf putter 22 having a golf club head 26 formed of a material attracted by magnetism and a golf ball marker 14 incorporating a magnet 58 therewithin may be utilized in other ways as a golf putting training aid. FIGS. 5 through 7 illustrate the manner of practice of the method of the invention in which one golf ball marker 14 is placed a few inches in front of a golf ball position, while a second golf ball marker 14 is placed a few inches behind the golf ball position. This practice technique may be utilized either with or without a golf ball 16. Either way, the golfer 10 first establishes a spherical golf ball position atop the golf putting practice surface 62, which in the illustrations of FIGS. 5 through 7 is the position of the golf ball 16.

The golfer 10 places one golf ball marker 14 on the golf putting practice surface 62 within six inches of the golf ball 16 and behind the rear face 38 of the golf club head 26. The lower most ball marker 14 illustrated in FIG. 5 is in this position along the line of the backswing behind the golf ball 16. The location of the golf ball marker 14 in this manner defines an imaginary straight horizontal ball travel alignment line 74 passing directly through the centers of both the golf ball position 16 and the ball marker 14. The line 74 defines the desired direction of golf ball travel when the golf ball 16 is putted. The location of the golf ball marker 14 on the golf putting practice surface 62 in this manner also defines an imaginary flat vertical impact-face plane 76 which is tangent to the golf ball position occupied by the golf ball 16. The plane 76 intersects and is perpendicular to the straight horizontal ball travel alignment line 74 defined between the centers of the golf ball 16 and the ball marker 14.

In the example illustrated in FIGS. 5 through 7, a second golf ball marker 14 is placed on the golf practice putting surface 62 directly in front of the golf ball 16. The position of the second marker is indicated by the upper golf ball marker 14 in FIGS. 5 through 7. Both of the golf ball markers 14 are located on the ball travel alignment line 74. The ball markers 14 are located on opposite sides of the vertical impact-face plane 76 from each other and are both preferably placed no closer than two inches to the impact-face plane 76 and no further than about six inches from it.

To practice the manner of implementation of the method of the invention illustrated in FIGS. 5 through 7 the golfer 10 holds the putter 22 by the grip 25 to address the golf ball 16 with the club head ball-impact face 28 of the club head 26 parallel to and only slightly behind the impact-face plane 76 as shown in FIG. 5. The ball-impact face 28 is located between the golf ball 16 and the lower golf ball marker 14 at the backswing position. The club head sole 30 is located proximate to the putting practice surface 62.

The golfer 10 then draws the putter club head 26 away from the golf ball 16 and toward the lower ball marker 14 in a backswing stroke as indicated by the directional arrow 18 in FIG. 6. While executing the backswing stroke the golfer holds the putter face 28 parallel to the impact-face plane 76 and the club head sole 30 proximate the putting practice surface 62. When the backswing stroke 18 is properly executed in this manner, the sole 30 of the club head 26 passes directly over the rear ball marker 14. The ball marker 14 is thereupon drawn by magnetism up into contact with the putter club head sole 30 making an audible "clicking" noise after it leaves the putting practice surface 62 and adheres to be club head sole 30. This audible sound provides assurance to the golfer 10 that the backswing 18 has been properly executed.

The golfer 10 then brings the putter club head 26 toward the golf ball 16 in a putting stroke and continues forward movement of the putter club head 26 in a proper putt and follow through indicated at 20 in FIG. 7. This movement strikes the golf ball 16 with the ball-impact face 28 in the ball impact-face plane 76 and with the club head sole 30 remaining proximate the putting practice surface 62. The continued forward movement of the club head 26 in a proper putt and follow through 20 maintains the front of ball-impact face 28 of the putter club head 26 parallel to the impact-face plane 76 while maintaining the putter club head sole 30 proximate the putting practice surface 62. With proper execution of the putt and follow through 20 the ball marker 14 in front of the golf ball 16, which is the upper ball marker 14 in FIGS. 5 through 7, is drawn up into attachment to the putter club head sole 30 by the force of magnetism exerted by the magnet 58 during the putting stroke. As the putter club head 26 passes over the uppermost ball marker 14 shown in FIGS. 5 through 7, a second audible "click" can be heard as the ball marker 14 located near the end of the follow through leaves the putting practice surface 62 and makes contact with the sole 30 of the putter club head 26.

If the golfer 10 executes an improper backstroke, for example by bringing the club head 26 up away from the putting practice surface 62 in an arcuate path, the club head 26 will not pass close enough to the magnetic field of the magnet 58 in the ball marker 14 at the backstroke position occupied by the lower ball marker 14 illustrated in FIGS. 5 through 7. As a consequence, the ball marker 14 will not attach itself to the sole 30 of the club head 26, and indeed may not even move at all. The absence of the audible "click" is an instant indication to the golfer 10 of improper execution of the backstroke 18. Similarly, if the golfer 10 does not execute a proper follow through 20, the forward or upper ball marker 14, illustrated in FIGS. 5 through 7,will not exert a sufficient force of magnetic attraction with respect to the club head 26 to cause it to leave the golf putting practice surface 62 and magnetically adhere to the sole 30 of the golf club head 26.

It is thus apparent that, if a golfer properly executes a putting stroke utilizing be putter 12 and the ball markers 14 in combination as a putting aid in the manner described in conjunction with FIGS. 5 through 7, the golfer will hear a successive pair of "clicks". These sounds are heard as the club head 26 successively passes over first the rear most ball marker 14 during the backswing and then over the forward ball marker 14 during the follow through. The rear ball marker 14 shown in FIGS. 5–7 first leaves the golf putting practice surface 62 and magnetically adheres to the sole 30 of the putter club head 26 with an audible click, followed by the forward ball marker 14. An absence of either of these audible signals indicates to the golfer improper execution of the putting stroke.

Undoubtedly, numerous variations and modifications of the invention will become readily apparent to those familiar with golf putting training systems and aids. For example, there are a number of different types of construction that may be used to create suitable magnetic ball markers. Exemplary alternative magnetic ball markers which may be utilized are described in U.S. application Ser. No. 09/426,786. Also, while the use of an actual golf ball 16 to establish the spherical golf ball position is illustrated in FIGS. 5–7, this manner of practice of the invention can be practiced with or without an actual golf ball. Accordingly, the scope of the invention should not be construed as limited to this specific embodiment of the structure of the invention nor the exemplary examples of implementation of the method thereof.

I claim:

1. A method of golf putting training on a putting practice surface utilizing a golf ball, a golf putter having a shaft with opposing ends and a grip at one end and a club head formed of a material attracted by magnetism at an opposite end, and said club head has a heel, a toe, a sole, and a flat, front ball-impact face, and further utilizing at least one flat golf ball marker that includes a permanent magnet permanently incorporated therein comprising:

placing said golf ball upon said golf putting surface, placing said golf ball marker on said ball-impact face offset from a point midway between said heel and said toe, whereupon said golf ball marker is held in position by magnetic force, holding said putter by said grip to address said golf ball with said club head ball-impact face oriented in a plane perpendicular to said putting practice surface while holding said sole of said club head proximate to said putting practice surface, drawing said putter club head away from said golf ball while holding said ball-impact face of said club head perpendicular to said putting practice surface and said sole of said club head proximate thereto, and bringing said putter club head toward said golf ball to strike said golf ball with said ball-impact face perpendicular to said putting practice surface while avoiding contact between said golf ball marker and said golf ball.

2. A method the according to claim 1 performed with a pair of flat golf ball markers as aforesaid further comprising: spacing said golf ball markers from each other on said ball-impact face with one of said ball markers located between said club head heel and a point midway between said club head heel and toe, and the other of said ball markers located between said club head toe and said point midway between said club head heel and toe.

3. A method the according to claim 2 further comprising locating said golf ball markers equidistant from said point midway between said club head heel and toe.

4. A method of golf putting training on a putting practice surface utilizing a golf putter having a shaft with a grip at one end and a club head formed of a material attracted by magnetism at an opposite end and said club head has a flat, front ball-impact face and a sole extending rearwardly from said front ball-impact face, and further utilizing at least one flat golf ball marker that includes a permanent magnet permanently incorporated therein comprising:

establishing a spherical golf ball position atop said golf putting practice surface, placing said golf ball marker on said golf putting practice surface within six inches of said golf ball position, whereby an imaginary straight horizontal ball travel alignment line passing directly beneath the centers of both said golf ball position and said golf ball marker defines a desired direction of golf ball travel when said golf ball is putted and an imaginary flat vertical impact-face plane is tangent to said golf ball position and intersects and is perpendicular to said straight horizontal ball travel alignment line between the centers of said golf ball and said ball marker, holding said putter by said grip to address said golf ball with said ball-impact face of said club head parallel to said impact-face plane and between said golf ball and said ball marker and with said club head sole located proximate to said putting practice surface, drawing said putter club head away from said golf ball and toward said golf ball marker in a backswing stroke while holding said putter ball-impact face parallel to said impact-face plane and said sole proximate said putting practice surface, whereby said ball marker is drawn by magnetism up into contact with said putter club head sole while making an audible noise as it does so, and bringing said putter club head toward said golf ball position in a putting stroke while maintaining said ball-impact face perpendicular to said desired direction of golf ball travel and said club head sole proximate said putting practice surface.

5. A method of golf putting training according to claim 4 employing a pair of flat golf ball markers as aforesaid and further comprising:

placing both of said golf ball markers on said golf putting practice surface as aforesaid and wherein said golf ball markers are both located on said ball travel alignment line and on opposite sides of said vertical impact-face plane from each other, and following through with movement of said putter during said putting stroke while maintaining said front ball-impact face of said putter club head perpendicular to said ball travel alignment line and said putter club head sole proximate said putting practice surface so that one of said ball markers is drawn up from said putting practice surface and magnetically adheres to said putter club head sole during said backswing stroke and the other of said ball markers is drawn up from said putting practice surface and magnetically adheres to said putter club head sole during follow through of said putting stroke.

6. A method the according to claim 5 wherein said ball markers are both placed on said golf putting practice surface within four inches of said impact-face plane.

7. A method according to claim 5 wherein said ball markers are both placed on said golf putting practice surface no closer to said impact-face plane than two inches.

* * * * *